US008938889B2

(12) United States Patent
Rosa et al.

(10) Patent No.: US 8,938,889 B2
(45) **Date of Patent: *Jan. 27, 2015**

(54) FOOTWEAR

(75) Inventors: Adriano Rosa, Caledonia, MI (US); Phil Gallant, Newbury Park, CA (US); Stuart Jenkins, Goleta, CA (US); Paul A. Labarbera, Santa Barbara, CA (US); Ken Shao, Goleta, CA (US); Nathan W. Crary, Portland, OR (US)

(73) Assignee: Deckers Outdoor Corporation, Goleta, CA (US)

( * ) Notice: Subject to any disclaimer, the term of this patent is extended or adjusted under 35 U.S.C. 154(b) by 411 days.

This patent is subject to a terminal disclaimer.

(21) Appl. No.: 13/330,845

(22) Filed: Dec. 20, 2011

(65) Prior Publication Data

US 2012/0137544 A1 Jun. 7, 2012

Related U.S. Application Data

(63) Continuation-in-part of application No. 12/041,958, filed on Mar. 4, 2008, now Pat. No. 8,079,159.

(60) Provisional application No. 60/893,273, filed on Mar. 6, 2007.

(51) Int. Cl.

| | |
|---|---|
| ***A43B 13/00*** | (2006.01) |
| ***A43B 7/14*** | (2006.01) |
| ***A43B 7/24*** | (2006.01) |
| ***A43B 13/12*** | (2006.01) |
| ***A43B 13/14*** | (2006.01) |

(52) U.S. Cl.

CPC ..... *A43B 7/144* (2013.01); *A43B 7/142* (2013.01); *A43B 7/143* (2013.01); *A43B 7/24* (2013.01); *A43B 13/122* (2013.01); *A43B 13/145* (2013.01)

USPC ..... 36/25 R; 36/114; 36/31

(58) Field of Classification Search

USPC ..... 36/25 R, 88, 91, 92, 103, 114, 31

See application file for complete search history.

(56) References Cited

U.S. PATENT DOCUMENTS

| | | | |
|---|---|---|---|
| D412,235 | S | 7/1999 | Taylor et al. |
| 5,926,974 | A | 7/1999 | Friton |
| 6,119,373 | A | 9/2000 | Gebhard et al. |
| 6,237,251 | B1 | 5/2001 | Litchfield et al. |
| 6,354,020 | B1 | 3/2002 | Kimball et al. |
| 6,438,873 | B1 | 8/2002 | Gebhard et al. |
| 6,516,540 | B2 | 2/2003 | Seydel et al. |
| 6,591,519 | B1 | 7/2003 | Ellis, III |

(Continued)

*Primary Examiner* — Marie Bays

(74) *Attorney, Agent, or Firm* — Greer, Burns & Crain, Ltd.

(57) ABSTRACT

A shoe has a forefoot portion, a midfoot portion, and a heel portion and comprises a sole having a base layer, a heel pedestal extending from the base layer, a lateral stabilizer pedestal extending from the base layer and positioned at least partially beneath the cuboid bone, and a medial stabilizer pedestal extending from the base layer and positioned at least partially beneath the navicular bone. During bipedal locomotion, the weight of a person wearing the shoe is supported on at least one of the heel pedestal, the lateral stabilizer pedestal, and the medial stabilizer pedestal, thereby transferring the person's weight from the heel pedestal, to the lateral stabilizer pedestal, and to the medial stabilizer pedestal. The heel pedestal, the lateral stabilizer pedestal, and the medial stabilizer pedestal include an outsole and a compressible base layer between the outsole and the wearer's foot.

17 Claims, 12 Drawing Sheets

(56) References Cited

U.S. PATENT DOCUMENTS

| | | | | |
|---|---|---|---|---|
| 6,658,766 | B2 | 12/2003 | Kraeuter et al. | |
| 6,662,470 | B2 | 12/2003 | Ellis, III | |
| 7,069,665 | B1 | 7/2006 | Adriano | |
| 8,079,159 | B1 * | 12/2011 | Rosa | 36/25 R |
| 2005/0210705 | A1 | 9/2005 | Grove et al. | |
| 2005/0217142 | A1 | 10/2005 | Ellis, III | |
| 2006/0213088 | A1 | 9/2006 | Grove et al. | |
| 2007/0240331 | A1 | 10/2007 | Borel | |
| 2008/0052965 | A1 | 3/2008 | Sato | |

* cited by examiner

FOOTWEAR

PRIORITY CLAIM

This application is a continuation-in-part application of U.S. patent application Ser. No. 12/041,958 filed on Mar. 4, 2008, which claims the benefit of U.S. provisional application Ser. No. 60/893,273, filed Mar. 6, 2007, which are incorporated herein in their entireties.

BACKGROUND

The invention relates generally to footwear, and specifically to footwear adapted to adjust posture and gait associated with different foot physiologies.

A significant number of people require some type of insert or other orthotic device to address anomalies in foot physiology and gait. Typically, addressing such anomalies consists of no more than a static adjustment of the arch support, or stabilization of the heel, or both. Little if any attention is paid to the forefoot, or the person's gait, when addressing foot anomalies.

Merely adjusting the arch support may affect a small component of a person's gait, but it cannot properly address the component of gait associated with the forefoot, i.e. supporting full body weight on the plantar portion of the foot, and pushing off to transfer the body weight to the other foot. An arch support does little to properly control the transfer of weight from the heel to the midfoot and thence to the forefoot that occurs while taking a step.

Attempts have also been made to improve lateral stability by incorporating a lateral extension of the sole into the shoe, particularly around the heel cup. While this may provide a wider base on which to support a person's weight when standing, lateral stability is substantially reduced upon transferring weight from the heel to the forefoot while taking a step. Furthermore, a wider base cannot control the progressive transfer of weight from the heel to the forefoot, and thus cannot properly address gait.

Gait, of course, is not static. Thus, adjustments to gait must take into account the entire process of bipedal locomotion (e.g. walking, running, etc.) from the heel first hitting the ground to the toes pushing off. Known shoes, especially athletic shoes, utilize a flat heel and a square heel cup wherein the Achilles portion of the heel cup defines a generally right angle with the sole. While this configuration may center the heel with respect to the heel cup, it does not properly position the heel relative to a person's weight, and does not control the transfer of weight from the heel through the mid-foot to the forefoot. One need only inspect a few well-worn heels to observe wear patterns that frequently extend along the lateral and medial edges of the heel, indicating the off-center character of weight distribution and gait in many people.

There is a need for footwear which can address anomalies in foot physiology more effectively than conventional footwear.

SUMMARY

A shoe has a forefoot portion, a midfoot portion, and a heel portion. The shoe comprises a sole, a heel pedestal, a lateral stabilizer pedestal, and a medial stabilizer pedestal. The sole has a base layer underlying the forefoot portion, the midfoot portion, and the heel portion for supporting the shoe upon a walking surface. The heel pedestal extends from the base layer beneath the heel portion. The lateral stabilizer pedestal extends from the base layer at least partially beneath the cuboid bone. The medial stabilizer pedestal extends from the base layer at least partially beneath the navicular bone. The heel pedestal, the lateral stabilizer pedestal, and the medial stabilizer pedestal are adapted so that, during bipedal locomotion, the weight of a person wearing the shoe will be supported on at least one of the heel pedestal, the lateral stabilizer pedestal, and the medial stabilizer pedestal. The heel pedestal, the lateral stabilizer pedestal, and the medial stabilizer pedestal are also adapted so that, during bipedal locomotion, the gait of a person wearing the shoe will be controlled by the progressive transfer of weight from the heel pedestal, to the lateral stabilizer pedestal, and thence to the medial stabilizer pedestal.

In another embodiment, the present shoe provides a sole including a forefoot portion, a midfoot portion, and a heel portion. The sole having a base layer for supporting the shoe upon a walking surface, a heel pedestal, a lateral stabilizer pedestal, and a medial stabilizer pedestal. The heel pedestal extends from the base layer beneath the heel portion. The lateral stabilizer pedestal extends from the base layer at least partially beneath the cuboid bone. The medial stabilizer pedestal extends from the base layer at least partially beneath the navicular bone. During bipedal locomotion, the weight of a person wearing the shoe will be supported on at least one of the heel pedestal, the lateral stabilizer pedestal, and the medial stabilizer pedestal, and the gait of the person will be controlled by the progressive transfer of weight from the heel pedestal, to the lateral stabilizer pedestal, and thence to the medial stabilizer pedestal. The heel pedestal, the lateral stabilizer pedestal, and the medial stabilizer pedestal include an outsole for contacting the surface and a compressible base layer between the outsole and the wearer's foot.

In a further embodiment, the present shoe provides a sole including a platform for supporting a wearer's foot upon a surface, where the shoe includes a heel pedestal extending from the platform beneath a wearer's heel, a lateral stabilizer pedestal extending from the platform at least partially beneath a wearer's cuboid bone and a medial stabilizer pedestal extending from the platform at least partially beneath a wearer's navicular bone. The heel pedestal, the lateral stabilizer pedestal, and the medial stabilizer pedestal include an outsole for contacting the surface, a first compressible base layer between the outsole and the wearer's foot and a second compressible layer between the first compressible layer and the wearer's heel.

In another embodiment, the present shoe provides a sole having a platform for supporting a wearer's foot upon a surface, and includes a heel pedestal extending from the platform beneath a wearer's heel, a lateral stabilizer pedestal extending from the platform at least partially beneath a wearer's cuboid bone and a medial stabilizer pedestal extending from the platform at least partially beneath a wearer's navicular bone. The heel pedestal, the lateral stabilizer pedestal, and the medial stabilizer pedestal include a single compressible layer, where the compressible layer includes a bottom surface having tread.

DETAILED DESCRIPTION

Figure 1:
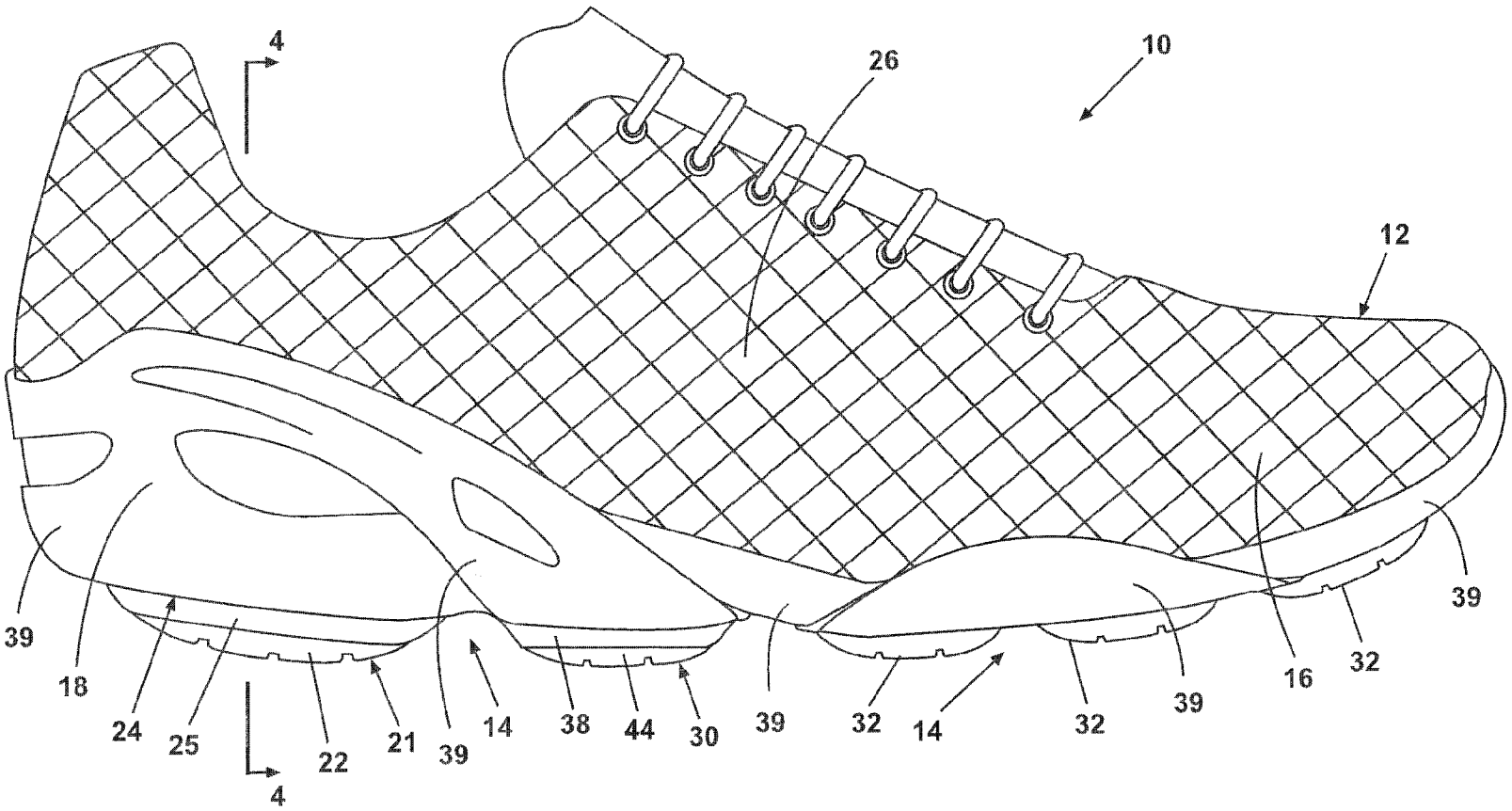
FIG. 1 is a side elevational view of an embodiment of a shoe according to the invention.

Referring to FIG. 1, an embodiment of the invention is illustrated comprising a shoe 10 having a generally known upper portion 12. The shoe 10 has a forefoot portion 16, such as a toe box, a midfoot portion 26 associated with a wearer's arch, and a heel portion 18, such as a heel cradle. The shoe 10 is illustrated as an athletic, lace-up style. However, the shoe 10 can be of any selected style.

Figure 2:
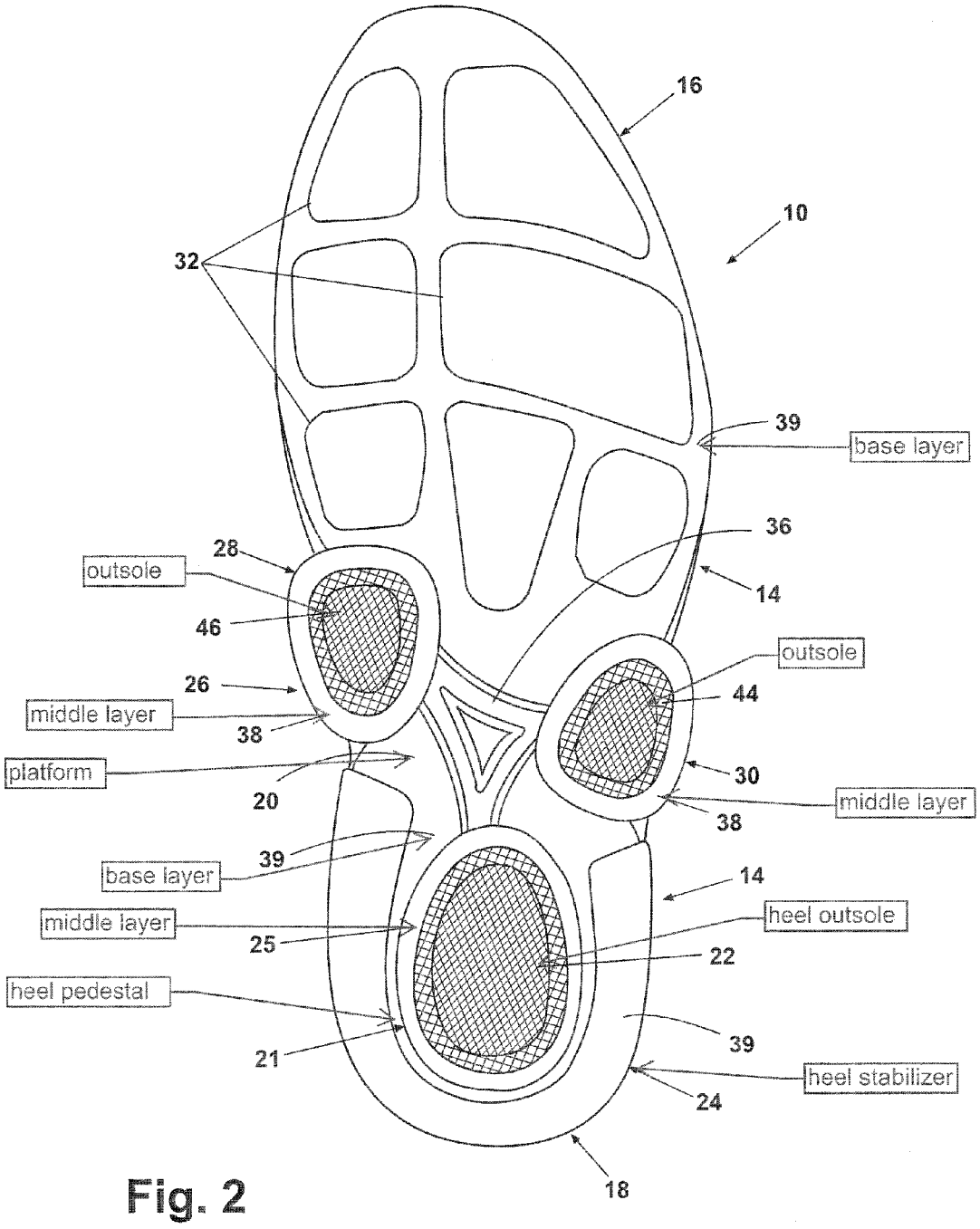
FIG. 2 is a view from the underside of the shoe illustrated in FIG. 1.

Referring also to FIG. 2, the shoe 10 has a sole 14 comprising a platform 20. The forefoot portion of the sole 14 comprises an array of forefoot support pads 32 integrated therein and extending away from the platform 20 for cushioning the forefoot, and providing traction and lateral stability. FIG. 2 illustrates an exemplary distribution and configuration of the support pads 32. However, the configuration and distribution of the support pads 32 can be selected based upon factors such as shoe flexibility, weight distribution in the forefoot portion, degree of cushioning, and the like.

The heel portion of the sole 14 comprises a heel pedestal 21 extending away from the platform 20 and centered generally beneath the heel bone. The heel pedestal 21 is illustrated as somewhat egg-shaped in plan view, although the heel pedestal 21 can be configured with other shapes, such as circular, triangular, oval, and the like. Extending generally arcuately along the perimeter of the heel portion 18 from the medial area to the lateral area of the heel portion 18 is a heel stabilizer 24 extending away from the platform 20. The heel pedestal 21 extends below the heel stabilizer 24 as illustrated in FIG. 1.

Depending from the platform 20 in the midfoot portion 26 are a medial stabilizer pedestal 28 and a lateral stabilizer pedestal 30. Both pedestals 28, 30 are positioned foreword of the heel stabilizer 24. The medial stabilizer pedestal 28 is positioned beneath the navicular bone (not shown) in order to provide support and control for the joints associated with the navicular. The lateral stabilizer pedestal 30 is positioned below the cuboid bone (not shown) in order to provide support and control for the joints associated with the cuboid. As illustrated in FIG. 2, the medial stabilizer pedestal 28 is generally positioned somewhat forward of the lateral stabilizer pedestal 30. Additionally, both pedestals 28, 30 are positioned to extend laterally beyond the perimeter of the sole 14. This provides an enhanced degree of lateral stability compared to a conventional sole. A rigid bridge 36 couples the heel pedestal 21 with the medial stabilizer pedestal 28 and the lateral stabilizer pedestal 30 to provide an integral, 3-point support structure.

Figure 3:
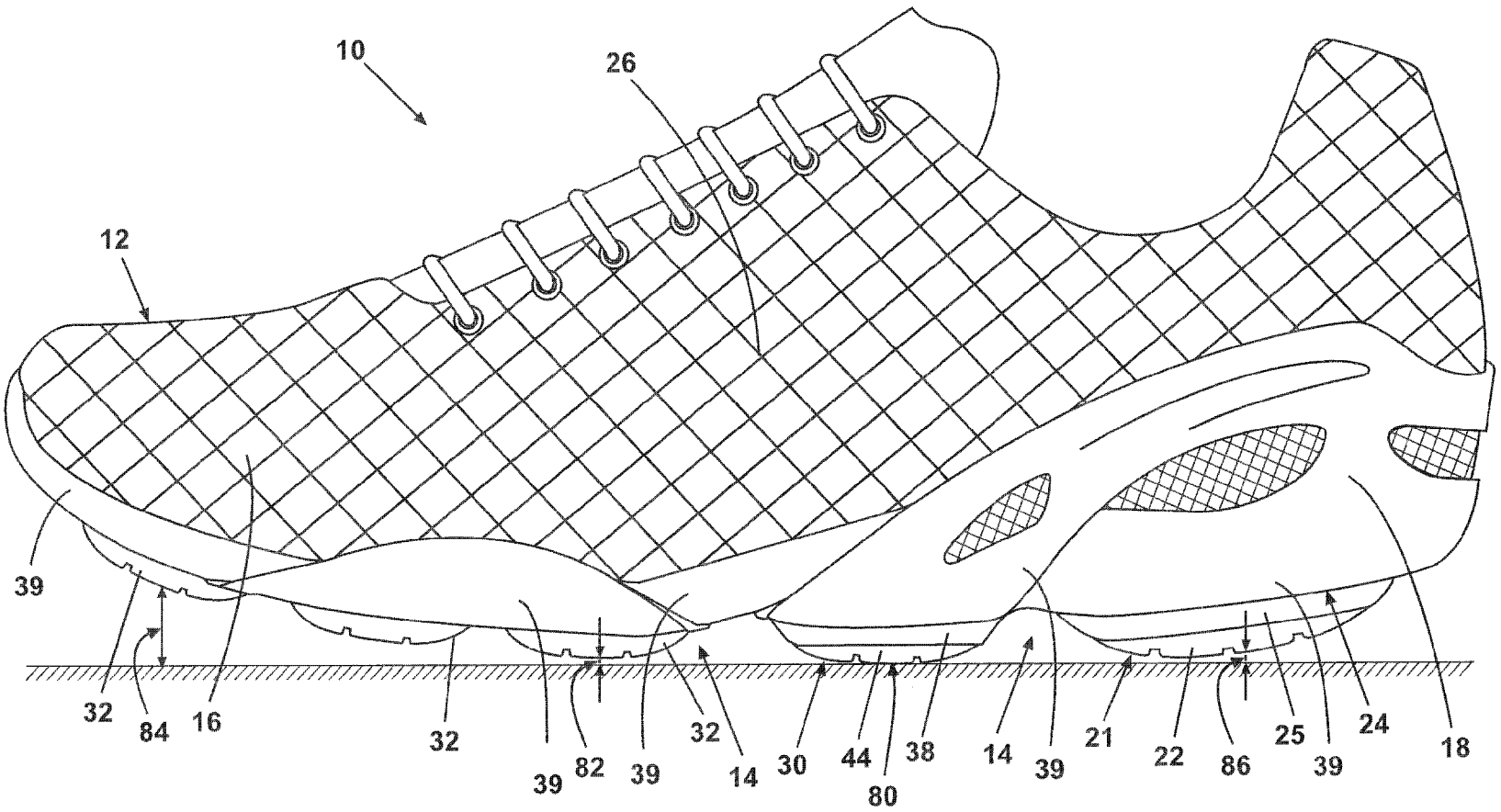
FIG. 3 is a side elevational view of the shoe illustrated in FIG. 1 showing the degree of rocker associated with the shoe.

As illustrated in FIG. 3, the shoe 10 is also configured to provide a selected degree of longitudinal forefoot rocker and heel rocker when the shoe is resting unworn on a horizontal surface. Rocker is defined in terms of the distance of selected reference points above a supporting surface with only the medial stabilizer pedestal 28 and the lateral stabilizer pedestal 30 in contact with the supporting surface. Thus, treating the supporting surface as the base reference line 80 with only the pedestals 28, 30 resting thereon, the intermediate height of the center of the adjacent forefoot support pad 32 will be between 2 and 4 millimeters. The forward height 84 of the center of the most distal forefoot support pad 32 will be between 2 and 3 centimeters, and the heel height 86 of the center of the heel pedestal 21 will be between 3 and 5 millimeters. With this profile, the shoe 10 is supported on the heel pedestal 21, the medial stabilizer pedestal 28, and the lateral stabilizer pedestal 30. This provides a 3-point support base for the user's foot which is highly stable and resistant to foot roll. While a wearer's weight may compress the pedestals 21, 28, 30 so that the forefoot portion 16 contacts the supporting surface, the pedestals 21, 28, 30 will play a significant role in supporting and controlling the wearer's weight during standing and bipedal locomotion.

Figure 5:
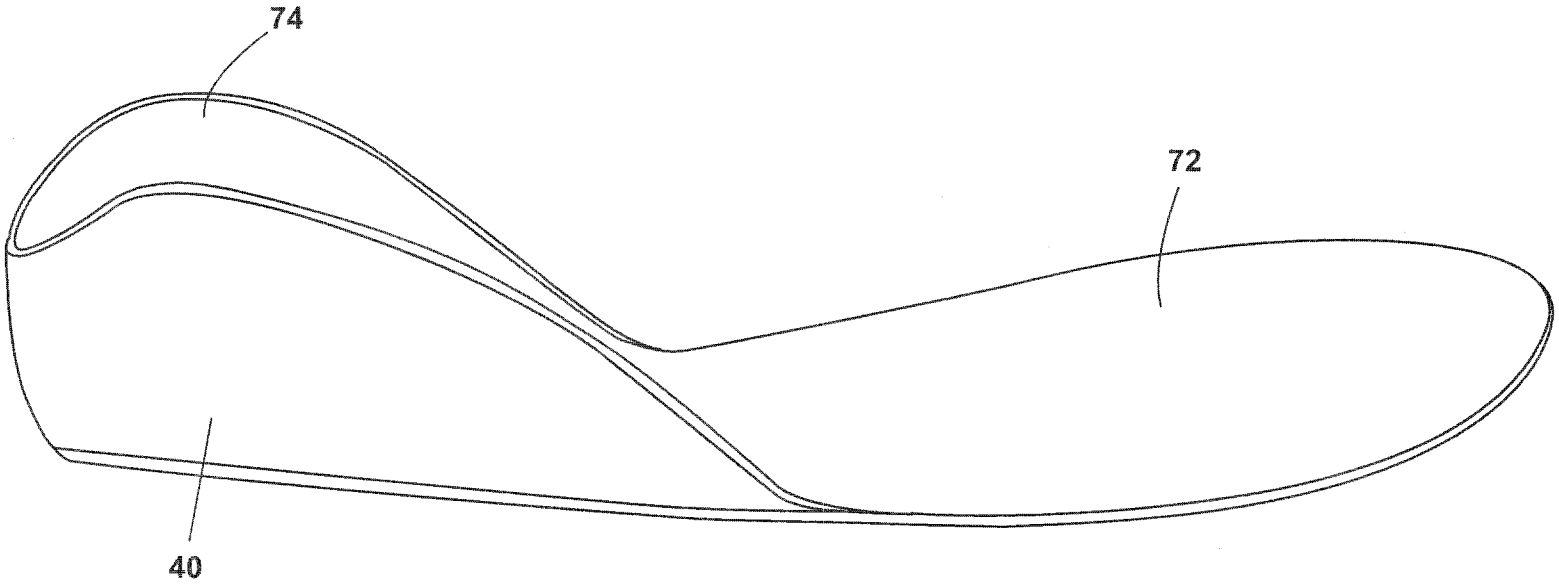
FIG. 5 is a perspective view of a stability shell forming part of the shoe illustrated in FIG. 1.
Figure 6:
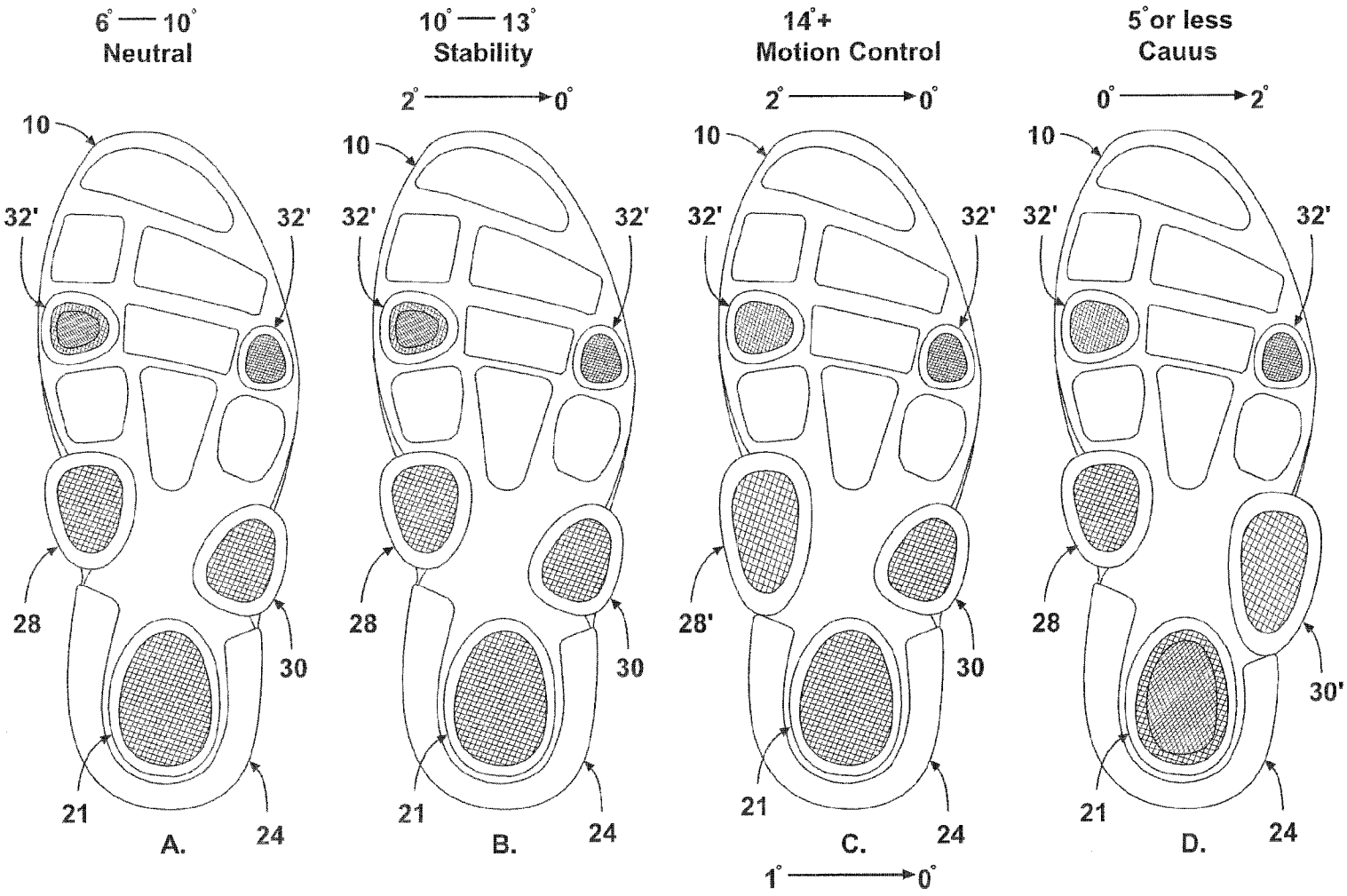
FIG. 6A is a plan view from the underside of the shoe illustrated in FIG. 1 providing a neutral degree of correction.
FIG. 6B is a view is similar to FIG. 6A of a shoe providing correction for a slight degree of late pronation.
FIG. 6C is a view similar to FIG. 6A of a shoe providing correction for an extensive degree of pronation.
FIG. 6D is a view similar to FIG. 6A of a shoe providing correction for supination.

The forefoot rocker is defined in part by a stability shell 40 as illustrated in FIG. 5. The stability shell 40 is a thin, semi-rigid, generally foot-shaped body having a plantar portion 72 and a heel cup 74. The plantar portion 72 can be flat, or can optionally have a somewhat longitudinally upwardly-curved profile. Any curvature of the plantar portion 72 may be adapted to be complementary to the longitudinal forefoot rocker of the shoe 10. The stability shell 40 can be integrated into the shoe 10 between the insole and the outsole. In addition to contributing to a selected degree of forefoot rocker, the stability shell 40 controls foot roll or twisting during bipedal locomotion. This control is provided because the stability shell 40 extends beneath the wearer's entire foot, encompassing the heel and extending to the ends of the toes.

Figure 4:
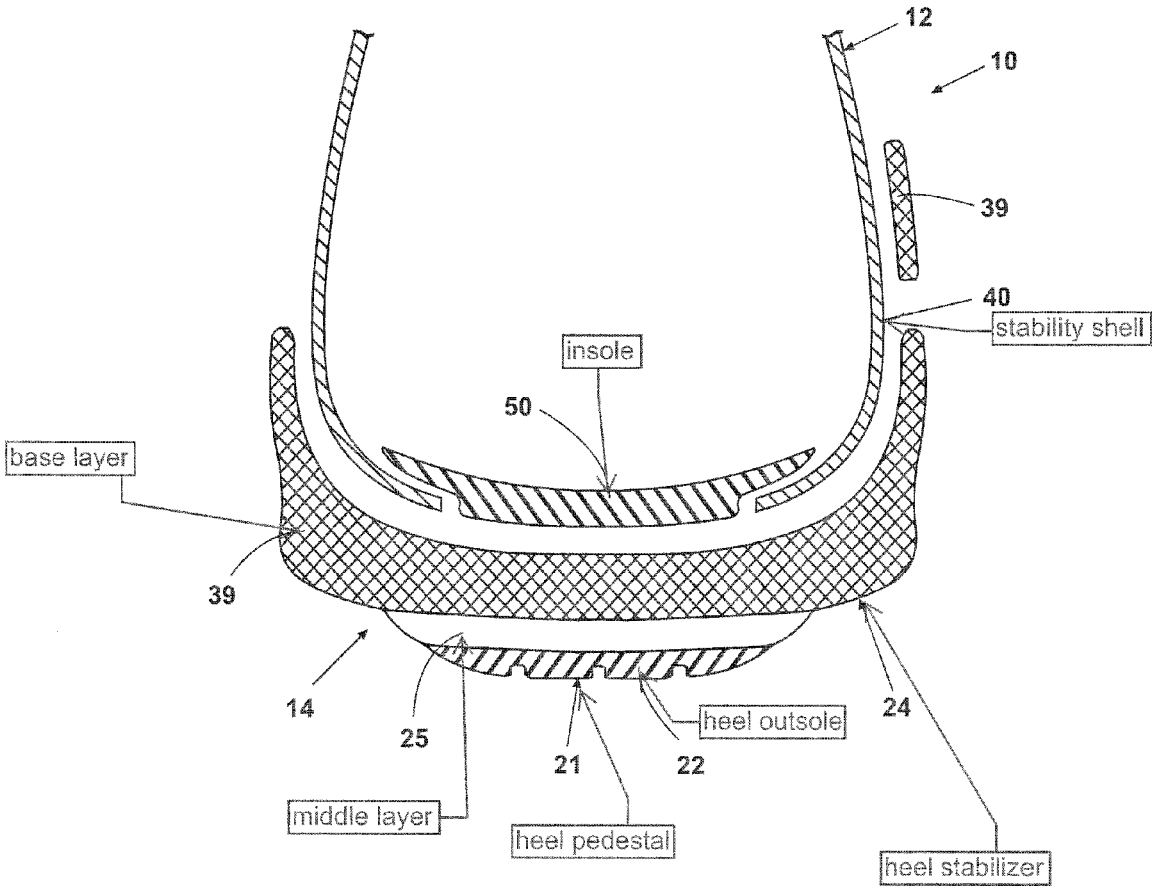
FIG. 4 is a schematic sectional view taken along view line 4-4 of FIG. 1.

FIG. 4 is a somewhat schematic sectional view through the heel portion of the shoe 10 illustrating a construction of the shoe 10. The heel pedestal 21 comprises a heel outsole 22, a highly compressible middle layer 25, and a relatively moderately compressible base layer 39. The heel outsole 22 comprises a tough, wear-resistant material, such as a rubber or other materials commonly used for shoe soles. The heel outsole 22 overlies the middle layer 25, which is fabricated of a compressible material, such as ethylene vinyl acetate (EVA). The middle layer 25 extends from the base layer 39, which is also fabricated of an EVA, but with a higher density and lower compressibility than the middle layer 25. To the inside of the base layer 39 is the stability shell 40. The stability shell 40 can be fabricated of a tough, moderately flexible material, such as a thermoplastic polyurethane (TPU). In the heel cup 74, the stability shell 40 can be configured with a cut-out adapted to receive a cushioning pad fabricated of a suitable cushioning material, such as EVA having a selected density and compressibility, to provide additional cushioning to the heel. Referring again to FIGS. 1 and 3, the base layer 39 can also be extended along the sides of the shoe 10 in a selected configuration to provide abrasion resistance and enhanced support, particularly the of heel.

Referring again to FIGS. 1 and 2, the medial stabilizer pedestal 28 and the lateral stabilizer pedestal 30 are similarly fabricated with a stabilizer pedestal outsole 46, 44, respectively, and a compressible middle layer 38 interposed between the outsole 44, 46 and the base layer 39.

In use, as a person takes a step, the heel is the first part of the foot to make contact with the walking or running surface. The rear portion of the heel stabilizer 24 will be brought into initial contact with the surface, and will compress moderately due to the moderately compressible properties of the heel stabilizer EVA. The compressibility of the heel stabilizer EVA will also contribute to lateral stability of the foot while the heel is supporting much of the wearer's weight. This lateral stability will facilitate a selected transfer of weight from the heel through the midfoot to the forefoot.

As the foot pitches forward, the heel pedestal 21 will contact the surface, and at least a portion of the wearer's weight will be transferred from the heel stabilizer 24 to the heel pedestal 21. The highly compressible midlayer 25 will compress, along with the less compressible base layer 39. The portions of the heel stabilizer 24 along the lateral and medial areas of the heel portion 18 will continue to carry some portion of the wearer's weight to provide lateral stability. However, the heel pedestal 21 will tend to maintain the selected lateral positioning of the heel to align the weight properly with respect to the heel bone. The heel cup 74 will also contribute to the selected positioning of the wearer's heel relative to the heel pedestal 21.

As the foot continues to pitch forward, the wearer's weight will be transferred, first to the lateral stabilizer pedestal 30, then to the medial stabilizer pedestal 28. As the weight is transferred to the lateral stabilizer pedestal 30, the pedestal 30 will compress somewhat, but will control undesirable supination. The relative positioning of the heel pedestal 21 and the lateral stabilizer pedestal 30 will control the early transfer of weight from the heel to the midfoot.

Additional movement will transfer some of the wearer's weight to the medial stabilizer pedestal 28. The medial stabilizer pedestal 28 will compress somewhat, but will control undesirable pronation. The relative positioning of the medial stabilizer pedestal 28 relative to the heel pedestal 21 and the lateral stabilizer pedestal 30 will control the progressive transfer of weight from the heel through the midfoot to the forefoot. FIG. 2 illustrates one configuration and positioning of the stabilizer pedestals 28, 30. The anticipated use of the shoe, e.g. athletics, casual wear, etc., may dictate variations in size, configuration, and placement of the stabilizer pedestals 28, 30 beyond that illustrated in FIG. 2.

At some point in the movement, the wearer's weight will be supported entirely on the 3-point support base consisting of the heel pedestal 21 the medial stabilizer pedestal 28, and the lateral stabilizer pedestal 30. This will properly orient the wearer's foot for transfer of the wearer's weight to the forefoot, thereby maintaining a selected gait without excessive pronation or supination. As the step is completed, and the person's weight is transferred to the forefoot, the forefoot support pads 32 will provide selected support to the individual bones in the plantar region of the foot, further controlling pronation or supination and facilitating maintenance of a selected gait.

FIGS. 6A-D illustrate 4 general conditions relating to foot orientation and gait in the context of the shoe described herein. The Figures illustrate 4 plan views of the sole of the shoe 10 for addressing the 4 conditions. Each condition is defined by the results of a calcaneal eversion measurement, such as taken with a subtalar joint goniometer (not shown) as described in Applicant's U.S. Pat. No. 7,069,665. Thus, for example, FIG. 6A relates to a calcaneal eversion measurement of 6-10°, FIG. 6B relates to a calcaneal eversion measurement of 10-13°, FIG. 6C relates to a calcaneal eversion measurement of 14° or greater, and FIG. 6D relates to a calcaneal eversion measurement of 5° or less. These are also referred to, respectively, as "neutral," "stability," "motion control," and "cavus." After determining whether a patient's foot presents as "neutral," "stability," "motion control," or "cavus," the shoe 10 can be further adjusted to accommodate each condition.

With a "neutral" condition, no further adjustment to the shoe is necessary. With a "stability" condition, also referred to as "late pronation," the shoe can be adjusted by raising the medial edge of the forefoot portion approximately 2° by a wedge or similar structure extending along the medial region of the forefoot portion from the forward end of the shoe to just forward of the medial stabilizer pedestal 28. The lateral edge is not raised. This will provide a lateral inclination of the forefoot portion ranging from zero to 2° across the forefoot portion toward the medial edge.

With a "motion control" condition, also referred to as "severe pronation," the shoe is adjusted by raising the medial edge of the forefoot portion approximately 2°, and the medial edge of the heel portion approximately 1°, by one or more wedges or similar structures. A single wedge can extend along the medial portion of the sole from the forefoot portion 16 to the heel portion 18 to provide a selected adjustment. The lateral edges are not raised. The wedge will provide a lateral inclination of the forefoot portion ranging from zero to 2° toward the medial edge, and a lateral inclination of the heel portion ranging from zero to 1° across the heel portion toward the medial edge. Additionally, the medial stabilizer pedestal 28' can be appropriately enlarged.

With a "cavus" condition, the shoe can be adjusted by raising the lateral edge of the forefoot portion approximately 2° by a wedge or similar structure extending along the lateral region of the forefoot portion from the forward end of the shoe to just forward of the lateral stabilizer pedestal 30. Additionally, the lateral stabilizer pedestal 30' can be appropriately enlarged. The medial edge of the forefoot portion is not raised. Adjustments to address the "cavus" condition will tend to control supination. The wedge will provide a lateral inclination of the forefoot portion ranging from zero to 2° toward the lateral edge.

Further refinements of the adjustments described above can be achieved by selected adjustments in selected forefoot support pads 32', such as size, height, compressibility, location, and the like.

Figure 7:
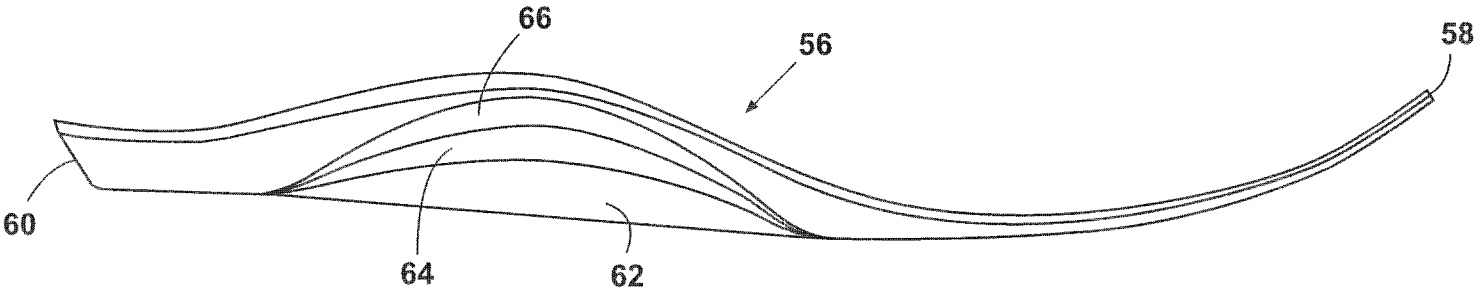
FIG. 7 is a side elevational view of an arch adjustment support for utilization in the shoe illustrated in FIG. 1 showing 3 progressively effective configurations.

As illustrated in FIG. 7, the shoe 10 can also be fitted with an arch support insert 56 comprising a forward end 58 extending to the ends of the toes, and a heel end 60 beneath the heel. The insert 56 can be provided with a low arch profile 62, a medium arch profile 64, or a high arch profile 66, based upon a selected arch profile appropriate for the person to whom the shoe 10 is being fitted. Alternatively, the stability shell 40 can be modified to include a selected arch profile. The insert 56 or stability shell 40 can thereby provide further support to the foot and control of the wearer's gait.

Referring now to FIGS. 8A-8L and 9A-9L, a further embodiment of the present article of footwear or shoe is illustrated where the shoe includes the three-point support structure described above. Specifically, the shoe includes a sole 100 having a heel portion 102, a medial portion 104 and a lateral portion 106 that respectively include a heel stabilizer pedestal 108, a medial stabilizer pedestal 110 and a lateral stabilizer pedestal 112. In this embodiment, the heel stabilizer pedestal 108, the medial stabilizer pedestal 110 and the lateral stabilizer pedestal 112 each include a single compressible layer or base compressible layer 114, and an outsole or outsole layer 116 that overlies and is attached to the base compressible layer. In the illustrated embodiment, the base compressible layer 114 is made with ethylene vinyl acetate (EVA). It should be appreciated that the base compressible layer 114 may be made with compression molded EVA (CMEVA), injection molded EVA (IMEVA), molded polyurethane or any suitable material or combination of materials. To reduce materials and costs, the base compressible layer 114 is a combination of the mid layer and base layer of the embodiments described above. Thus, the base compressible layer 114 provides cushioning as well as stability to a wearer's foot during bipedal motion.

Figures 8A, 8B, 8C, 8D, 8E, 8F, 8G, 8H, 8I, 8J, 8K, 8L:
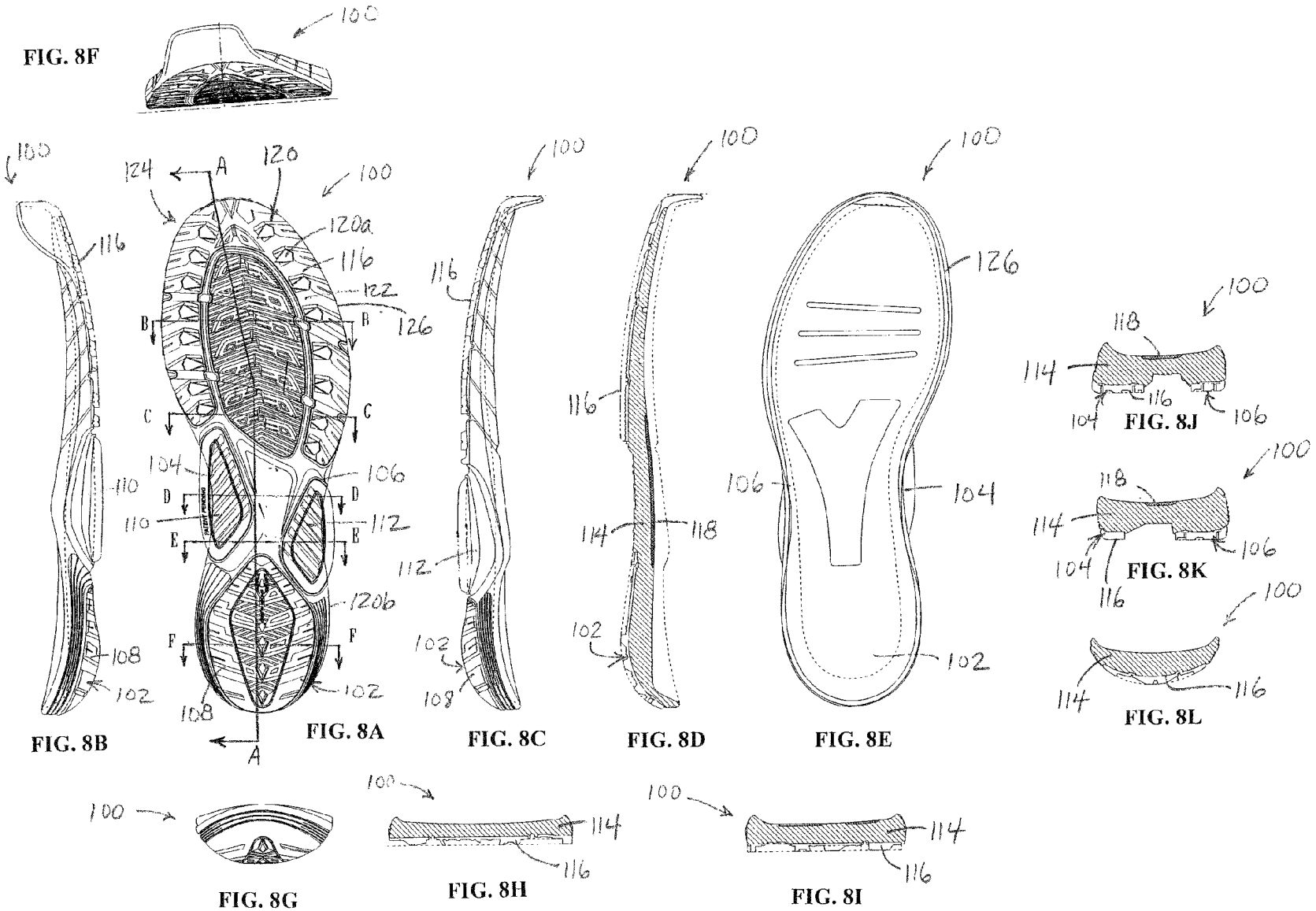
FIG. 8A is bottom view of an embodiment of a sole of a shoe according to the present invention.
FIG. 8B is a right side view of the sole of FIG. 8A.
FIG. 8C is a left side view of the sole of FIG. 8A.
FIG. 8D is a section view of the sole taken substantially along the line A-A in FIG. 8A.
FIG. 8E is top view of the sole of FIG. 8A.
FIG. 8F is a front view of the sole of FIG. 8A.
FIG. 8G is a rear view of the sole of FIG. 8A.
FIG. 8H is a section view of the sole taken substantially along the line B-B in FIG. 8A.
FIG. 8I is a section view of the sole taken substantially along the line C-C in FIG. 8A.
FIG. 8J is a section view of the sole taken substantially along the line D-D in FIG. 8A.
FIG. 8K is a section view of the sole taken substantially along the line E-E in FIG. 8A.
FIG. 8L is a section view of the sole taken substantially along the line F-F in FIG. 8A.
Figures 9A, 9B, 9C, 9D, 9E, 9F, 9G, 9H, 9I, 9J, 9K, 9L:
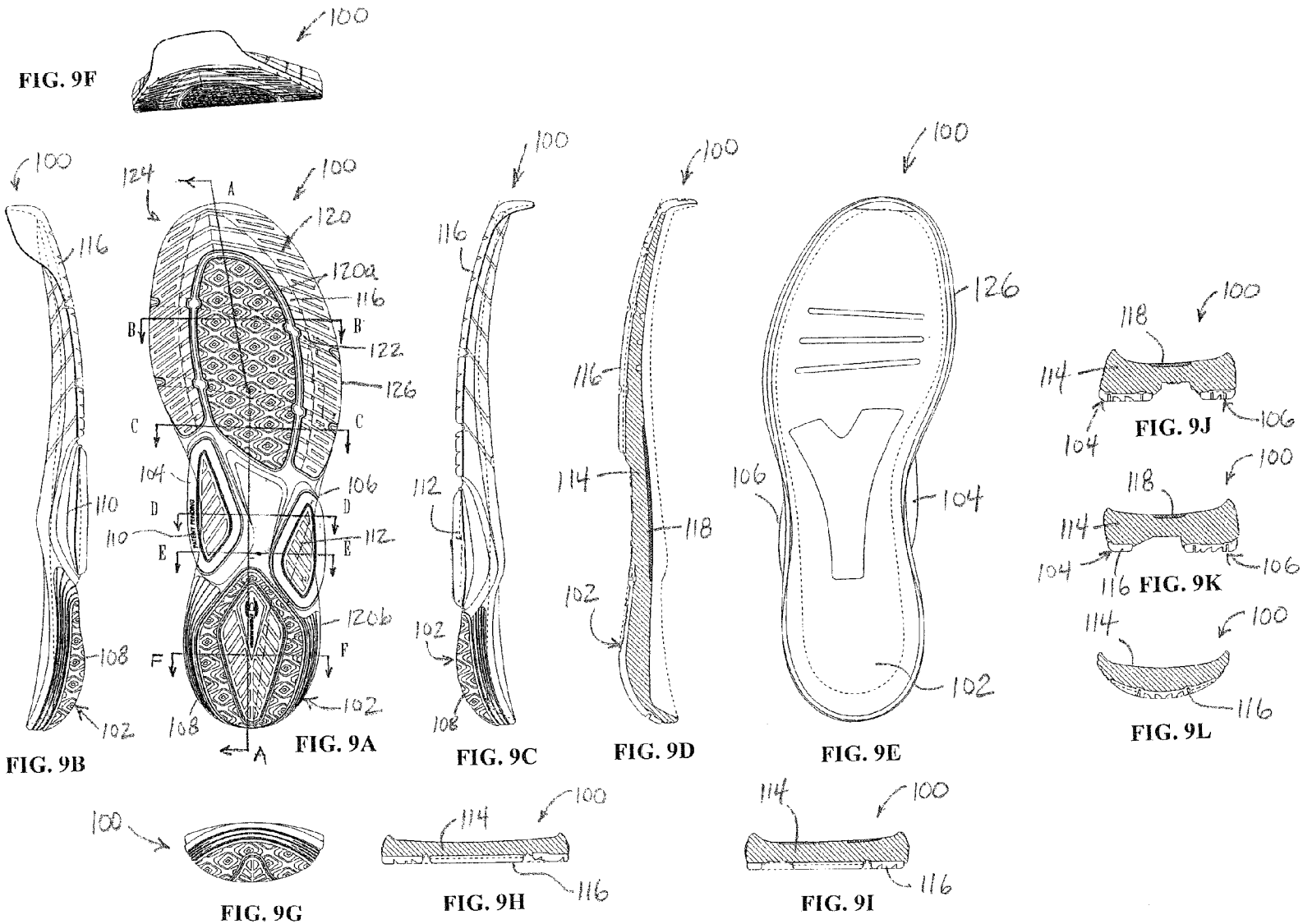
FIG. 9A is bottom view of another embodiment of a sole of a shoe according to the present invention.
FIG. 9B is a right side view of the sole of FIG. 9A.
FIG. 9C is a left side view of the sole of FIG. 9A.
FIG. 9D is a section view of the sole taken substantially along the line A-A in FIG. 9A.
FIG. 9E is top view of the sole of FIG. 9A.
FIG. 9F is a front view of the sole of FIG. 9A.
FIG. 9G is a rear view of the sole of FIG. 9A.
FIG. 9H is a section view of the sole taken substantially along the line B-B in FIG. 9A.
FIG. 9I is a section view of the sole taken substantially along the line C-C in FIG. 9A.
FIG. 9J is a section view of the sole taken substantially along the line D-D in FIG. 9A.
FIG. 9K is a section view of the sole taken substantially along the line E-E in FIG. 9A.
FIG. 9L is a section view of the sole taken substantially along the line F-F in FIG. 9A.

As shown in FIG. 8D, a shank 118 overlies and is attached to at least a portion of the top surface of the compressible base layer 114. The shank 118 is preferably made of a rigid material, such as plastic or a plastic composite material, for providing rigidness and stability to the mid portion of the sole to minimize bending at the middle or mid portion of the sole. The shank 118 is an optional component of the sole and is included depending on the design and/or intended end use of the sole and/or shoe. Thus, the sole may be made with or without the shank 118.

As shown in FIG. 8A, the outsole layer 116 has a plurality of lugs 120 that extend from a bottom surface 122 of the outsole for providing traction. More specifically, a forefoot portion 124 of the outsole layer 116 includes a first plurality of lugs 120*a* that extend about a periphery 126 of the forefoot portion and different lugs 120*b* extend from the bottom surface 122 of the outsole layer 116 in the heel portion 102. The outsole layer 116 is preferably made with a molded rubber or blown rubber. It should be appreciated that the outsole layer may be made with any suitable material or combination of materials and the size and shape of the lugs may be the same or different in the forefoot portion 124 and heel portion 102 of the shoe. FIGS. 8A-8L and 9A-9L employ the same sole structure and materials described above except that the outsole layers, i.e., the tread patterns and lug size and shape, are different.

Figures 10A, 10B, 10C, 10D, 10E, 10F, 10G, 10H, 10I, 10J, 10K:
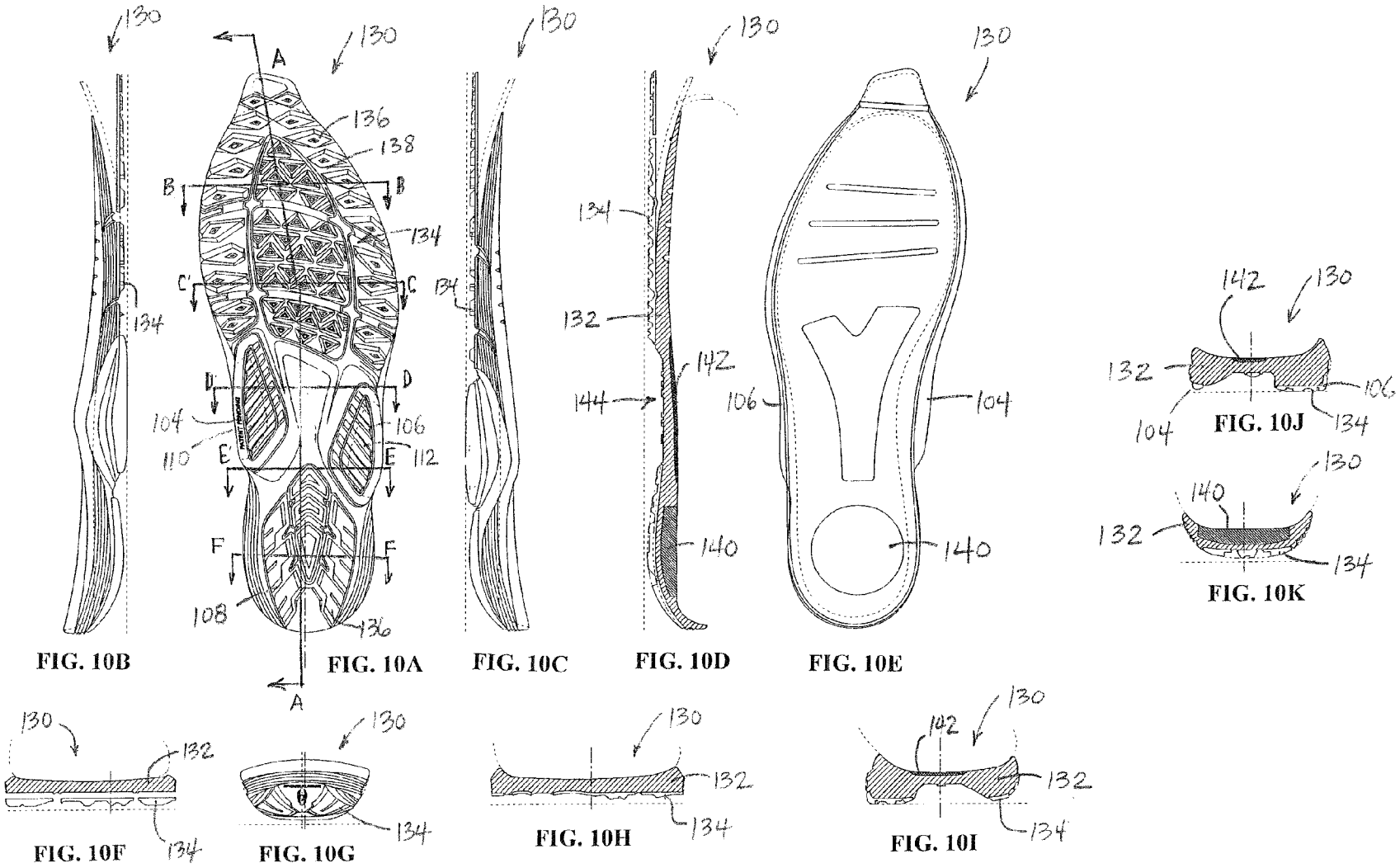
FIG. 10A is bottom view of another embodiment of a sole of a shoe according to the present invention.
FIG. 10B is a right side view of the sole of FIG. 10A.
FIG. 10C is a left side view of the sole of FIG. 10A.
FIG. 10D is a section view of the sole taken substantially along the line A-A in FIG. 10A.
FIG. 10E is top view of the sole of FIG. 10A.
FIG. 10F is a section view of the sole taken substantially along the line B-B in FIG. 10A.
FIG. 10G is a rear view of the sole of FIG. 10A.
FIG. 10H is a section view of the sole taken substantially along the line C-C in FIG. 10A.
FIG. 10I is a section view of the sole taken substantially along the line D-D in FIG. 10A.
FIG. 10J is a section view of the sole taken substantially along the line E-E in FIG. 10A.
FIG. 10K is a section view of the sole taken substantially along the line F-F in FIG. 10A.
Figures 11A, 11B, 11C, 11D, 11E, 11F, 11G, 11H, 11I, 11J:
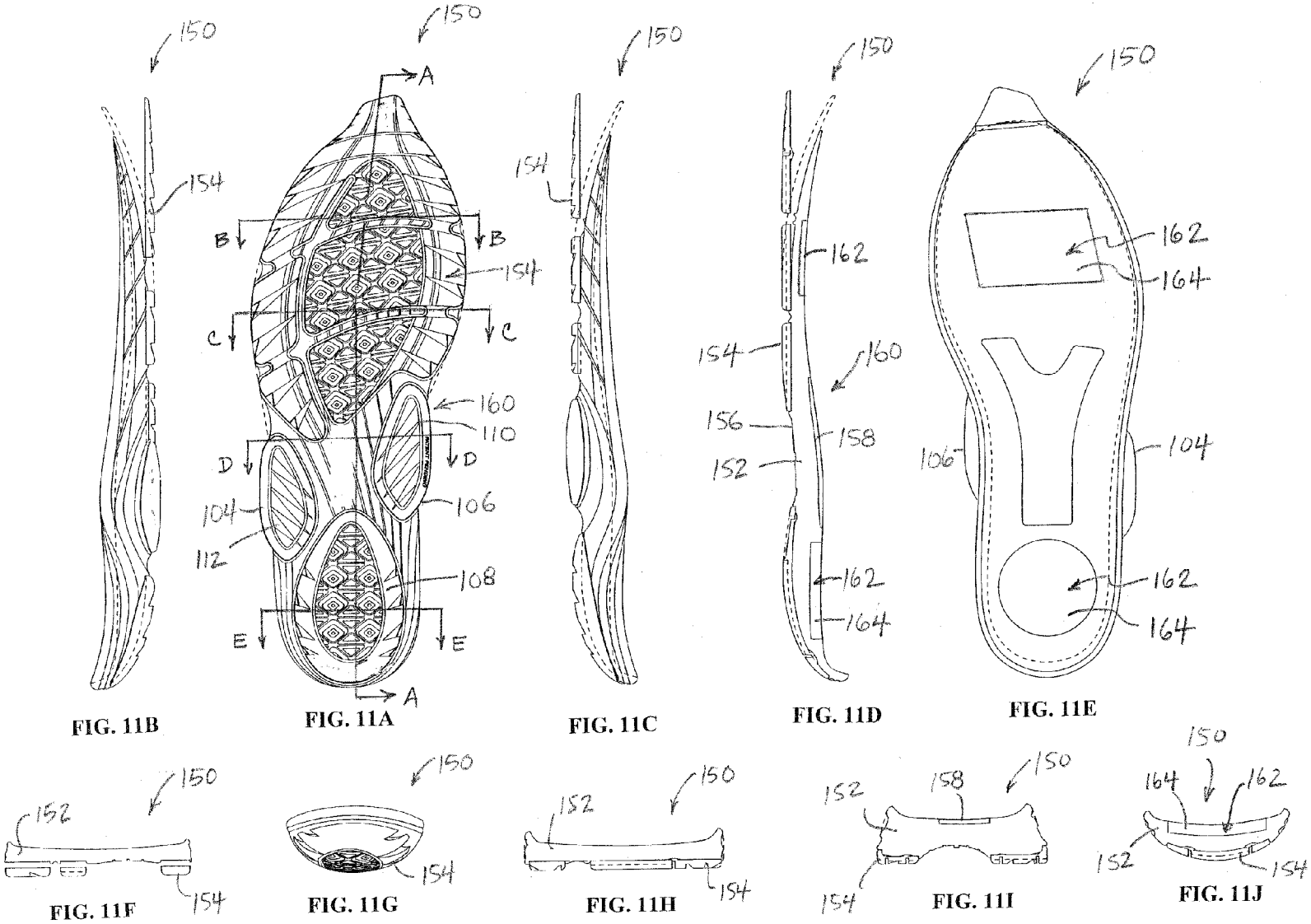
FIG. 11A is bottom view of a further embodiment of a sole of a shoe according to the present invention.
FIG. 11B is a right side view of the sole of FIG. 11A.
FIG. 11C is a left side view of the sole of FIG. 11A.
FIG. 11D is a section view of the sole taken substantially along the line A-A in FIG. 11A.
FIG. 11E is top view of the sole of FIG. 11A.
FIG. 11F is a section view of the sole taken substantially along the line B-B in FIG. 11A.
FIG. 11G is a rear view of the sole of FIG. 11A.
FIG. 11H is a section view of the sole taken substantially along the line C-C in FIG. 11A.
FIG. 11I is a section view of the sole taken substantially along the line D-D in FIG. 11A.
FIG. 11J is a section view of the sole taken substantially along the line E-E in FIG. 11A.

Referring now to FIGS. 10A-10K, another embodiment of the present shoe is illustrated where the shoe includes a sole 130 having a first or base compressible layer 132 and an outsole or outsole layer 134 that overlies and is attached to the base compressible layer. Similar to the above embodiments, the base compressible layer 132 is preferably made of EVA but may be made of CMEVA, IMEVA, molded polyurethane or any suitable material or combination of materials. The outsole layer 134 is made of a durable material, such as molded or blown rubber, and is formed to have a plurality of lugs 136 and grooves 138. In addition to the first compressible layer 132 and the outsole layer 134, the sole 130 includes a second compressible layer 140 that is attached to, molded with or embedded in the first compressible layer 132 as shown in FIG. 10D. The second compressible layer 140 is preferably positioned in the heel portion 102 of the sole 130 to absorb shock from impact forces on the shoe generated during walking, jogging or running. Similar to the first compressible layer 132, the second compressible layer 140 is made of EVA to provide cushioning to a wearer's heel. It should be appreciated that the second compressible layer 140 may also be made with CMEVA, IMEVA, molded polyurethane or a gel or gel-like material. In an embodiment, the first and second compressible layers 132, 140 are made with EVA and have the same densities. It is contemplated that the first and second compressible layers 132, 140 may have the same or different densities.

As in the above embodiments, the shoe shown in FIGS. 10A-10K includes an optional shank 142 that overlies and is attached to a middle portion 144 of the sole 130 to provide stability and rigidity to the middle portion. The shank 142 may be made of plastic or any suitable material or combination of materials. It should be noted that the embodiments of the sole shown in FIGS. 8A-8L, 9A-9L and 10A-10K, include outsole layers with different tread patterns having lugs and recesses with different shapes and sizes.

Referring now to FIGS. 11A-11J, a further embodiment of the present shoe is illustrated where the shoe includes a sole 150 having similar material layers to the sole shown in FIGS. 10A-10K. In this embodiment, the sole 150 includes a first or base compressible layer 152 and an outsole or outsole layer 154 that overlies and is attached to a bottom surface 156 of the base compressible layer. The sole 150 also includes a shank 158 that overlies and is attached to a middle portion 160 of the sole and a second compressible layer 162 that is molded to or otherwise attached to a heel portion 102 of the sole. It should be appreciated that the shank 158 is optional and therefore, the sole 150 can be made without the shank. The second compressible layer 162 provides additional cushioning to a wearer's heel, and is specifically made of a gel 164 for absorbing shock on the wearer's heel resulting from impact forces on the shoe due to bipedal motion such as walking, jogging or running. In the illustrated embodiment, the forefoot portion 165 of the sole 150 also includes the second compressible layer 162. It should be appreciated that the second compressible layer 162 may be attached to certain portions of the sole, such as the forefoot and heel portions, or extend along the entire length of the sole. It should also be appreciated that the second compressible layer 162 may be made of a gel, a combination of gels or any other suitable material or combination of materials.

Figure 12A:
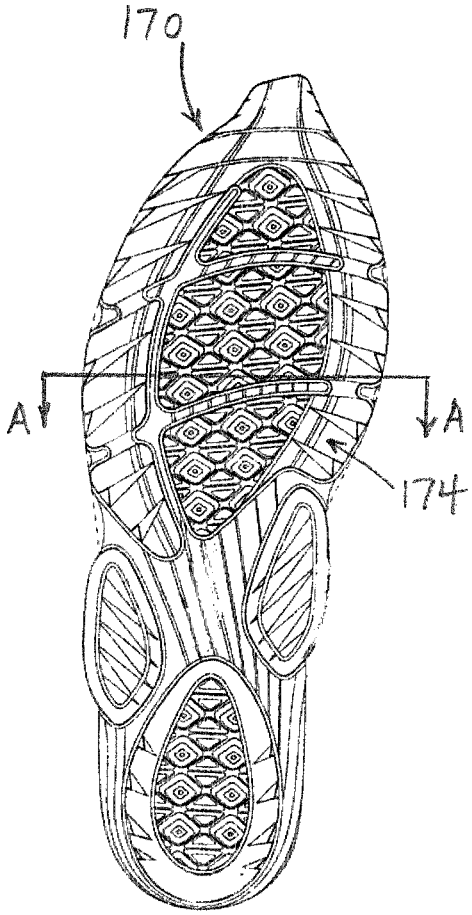
FIG. 12A is bottom view of another embodiment of a sole of a shoe according to the present invention.
Figure 12B:
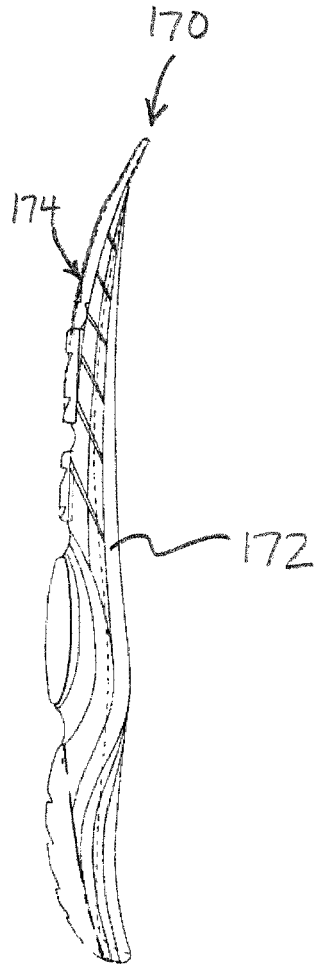
FIG. 12B is a left side view of the sole of FIG. 12A.
Figure 12C:
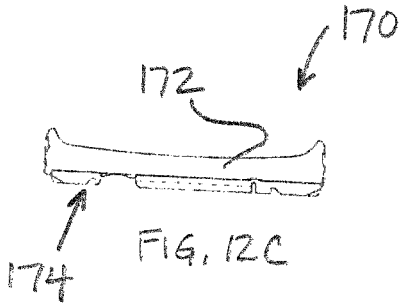
FIG. 12C is a section view of the sole taken substantially along the line A-A in FIG. 12A.

Referring now to FIGS. 12A-12C, another embodiment of the sole is illustrated where the sole 170 is made of a single compressible layer 172 ("unit-sole" construction) and does not include an outsole layer. In the illustrated embodiment, the compressible layer 172 is molded to have tread 174 and is made of a durable material, such as a compressible foam, or any material or combination of materials described above. It should be appreciated that the compressible layer 172 can be molded in either single or multiple densities.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A shoe having a sole including a platform for supporting a wearer's foot upon a surface, the shoe comprising:

a single heel pedestal extending from the platform and centrally positioned beneath a wearer's heel;

a lateral stabilizer pedestal extending from the platform at least partially beneath a wearer's cuboid bone; and a medial stabilizer pedestal extending from the platform at least partially beneath a wearer's navicular bone;

wherein the heel pedestal, the lateral stabilizer pedestal, and the medial stabilizer pedestal include an outsole for contacting the surface and a single compressible layer between the outsole and the wearer's foot, and the medial stabilizer pedestal is positioned closer to a forefoot portion of the shoe than the lateral stabilizer pedestal.

2. The shoe according to claim 1, wherein the compressible layer comprises an ethylene vinyl acetate.

3. The shoe according to claim 1, further comprising a heel stabilizer extending at least partially along the perimeter of the heel portion.

4. The shoe according to claim 3, wherein the heel stabilizer is integral with the compressible layer.

5. The shoe according to claim 3, wherein the heel stabilizer comprises the same material as the compressible layer.

6. The shoe according to claim 1, further comprising a stability shell having a plantar portion for supporting a wearer's forefoot, and a heel cup for cradling a wearer's heel.

7. The shoe according to claim 6, wherein the stability shell is integral with the sole.

8. The shoe according to claim 1, and further comprising a bridge coupling the heel pedestal, the medial stabilizer pedestal, and the lateral stabilizer pedestal into an integral, 3-point structure for supporting the wearer's foot.

9. A shoe having a sole including a platform for supporting a wearer's foot upon a surface, the shoe comprising:

a heel pedestal extending from the platform beneath a wearer's heel;

a lateral stabilizer pedestal extending from the platform at least partially beneath a wearer's cuboid bone; and a medial stabilizer pedestal extending from the platform at least partially beneath a wearer's navicular bone;

wherein the heel pedestal, the lateral stabilizer pedestal, and the medial stabilizer pedestal include an outsole for contacting the surface, a first compressible base layer between the outsole and the wearer's foot and a second compressible layer between the first compressible layer and the wearer's heel.

10. The shoe of according to claim 9, wherein the first and second compressible layers are made of different materials.

11. The shoe of according to claim 9, wherein the second compressible layer includes a gel.

12. The shoe of according to claim 9, wherein the first and second compressible layers include materials having different densities.

13. The shoe according to claim 9, wherein the first and second compressible layers include ethylene vinyl acetate.

14. The shoe according to claim 9, and further comprising a bridge coupling the heel pedestal, the medial stabilizer pedestal, and the lateral stabilizer pedestal into an integral, 3-point structure for supporting the wearer's foot.

15. A shoe having a sole including a platform for supporting a wearer's foot upon a surface, the shoe comprising:

a single heel pedestal extending from the platform and centrally positioned beneath a wearer's heel;

a lateral stabilizer pedestal extending from the platform at least partially beneath a wearer's cuboid bone; and a medial stabilizer pedestal extending from the platform at least partially beneath a wearer's navicular bone;

wherein the heel pedestal, the lateral stabilizer pedestal, and the medial stabilizer pedestal each include a single compressible layer and an outsole layer having tread, and the medial stabilizer pedestal is positioned closer to a forefoot portion of the shoe than the lateral stabilizer pedestal, wherein the outsole layers of the heel pedestal, the lateral stabilizer pedestal and the medial stabilizer pedestal are separated from each other.

16. The shoe according to claim 15, wherein said compressible layer is made of a foam material.

17. The shoe according to claim 15, wherein said compressible layer is molded in either single or multiple densities.

* * * * *